US005411009A

United States Patent [19]

Thompson et al.

[11] Patent Number: 5,411,009

[45] Date of Patent: May 2, 1995

[54] COMPOUND BOW ANTI VIBRATION AND NOISE DEVICE

[76] Inventors: Myron P. Thompson, 101 Louisa Ave., Rosepine, La. 20659; Cecil E. Thompson, Jr., Rte. 8 Box 911, Deridder, La. 70674

[21] Appl. No.: 192,058

[22] Filed: Feb. 4, 1994

[51] Int. Cl.[6] ..... F41B 5/00

[52] U.S. Cl. ..... 124/89; 124/88

[58] Field of Search ..... 124/89, 88, 86, 23.1, 124/25.6, 24.1

[56] References Cited

U.S. PATENT DOCUMENTS 4,570,608 2/1986 Masterfield ..... 124/89
4,893,606 1/1990 Sisko ..... 124/89
4,982,719 1/1991 Haggard et al. ..... 124/89
5,016,602 5/1991 Mizek ..... 124/89
5,044,351 9/1991 Pfeifer ..... 124/89
5,090,396 2/1992 Bickel et al. ..... 124/89
5,273,022 12/1993 Leven ..... 124/89

*Primary Examiner*—Randolph A. Reese
*Assistant Examiner*—Harry C. Kim
*Attorney, Agent, or Firm*—Rod Bryant Jordan

[57] ABSTRACT

An apparatus for eliminating noise and vibration from compound bows comprising a fluid filled tube mounted horizontally to the bow body having a cylinder mounted within the tube, and a tuning rod or wire mounted within the cylinder. The vibrations from the bow travel down the tuning wire within the cylinder and are absorbed by the fluid within the tube.

3 Claims, 2 Drawing Sheets

COMPOUND BOW ANTI VIBRATION AND NOISE DEVICE

BACKGROUND OF THE INVENTION

One of todays most popular sports is that of bow hunting. The technology recently developed has allowed this ancient weapon to compete with firearms and become the weapon of choice for many of todays more sporting hunters. Range, accuracy, and ease of operation have all been improved. One area of great importance in which there is room for much improvement is that of noise and vibration. It is in this area that the invention, as described herein, is intended to provide improvement.

DESCRIPTION OF THE PRIOR ART

There have been attempts in the past to address the problems of noise and vibration reduction in archery. Anti vibration devices, though partially successful, are far surpassed in performance by the invention as described herein.

SUMMARY OF THE INVENTION

The bow silencer, as described herein, comprises an apparatus that is mounted to the body of a compound bow. The apparatus is essentially a tube, or barrel, mounted to the body by way of a mounting stud on the rear of the tube. Within the tube there is another barrel, or inner barrel. The outer barrel is equipped with a mounting stud at its rearward end and is mounted to the front of the bow body by way of the stud in a horizontal position, pointing forward. The forward end of the outer barrel is completely closed except for a removable plug through which the outer barrel is filled with oil, or some other suitable liquid. The rearward end of the outer barrel is completely closed by a back insert to which the mounting stud is centrally affixed.

The inner barrel is not plugged at either end. One end is mounted to the rearward end, or back insert, of the outer barrel. The inner barrel is rigidly mounted in the center of the outer barrel and extends forward approximately three quarters of the way to the forward end of the outer barrel. A tuning wire, consisting of an elongated loop of wire is affixed within the inner barrel. The forward end of the tuning wire is a closed loop. The rearward end of the tuning wire is open ended, with the two ends welded to the center of the forward end of the mounting stud which slightly traverses the center of the back insert. The forward loop of the tuning wire extends just past the forward end of the inner barrel. A tuning spacer, which consists of a soft pliable plastic tube, is slipped over the forward loop and acts as a spacer which holds the tuning wire in place. The rearward portion of the tuning wire loop is squeezed into a position in which the individual wires are parallel and tack welded together at two points just forward of the point at which the tuning wire ends are welded to the mounting stud. This gives the side view of the tuning wire the approximate shape of a cross sectional view of a baseball bat. When the bow is drawn and released, the vibrations of the bow are transferred to the tuning wire through the mounting stud. These vibrations travel down the tuning wire and are absorbed by the fluid within the outer barrel. By properly adjusting the resonance of the tuning wire, a result may be attained wherein virtually all vibration is absorbed with very little vibration traveling back down the wire to the bow.

The points where the tuning wire are welded together, or tacks, also aid in preventing vibrations from returning to the bow. The apparatus gives the bow to which it is mounted a better feel and greater accuracy due to reduced vibrations and eliminates excess noise which may frighten game. These features distinguish the Anti Vibration and Noise Device as an important improvement in high technology compound bows.

BRIEF DESCRIPTION OF THE DRAWINGS

Figure one is a side elevation view of a bow equipped with the device.

Figure two is a cross sectional view of the anti vibration device.

DETAILED DESCRIPTION

Figure 1:
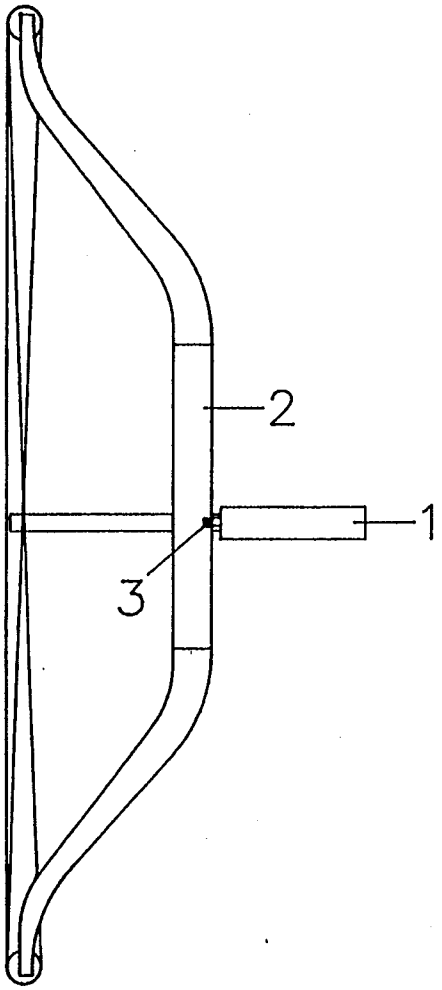
Figure 2:
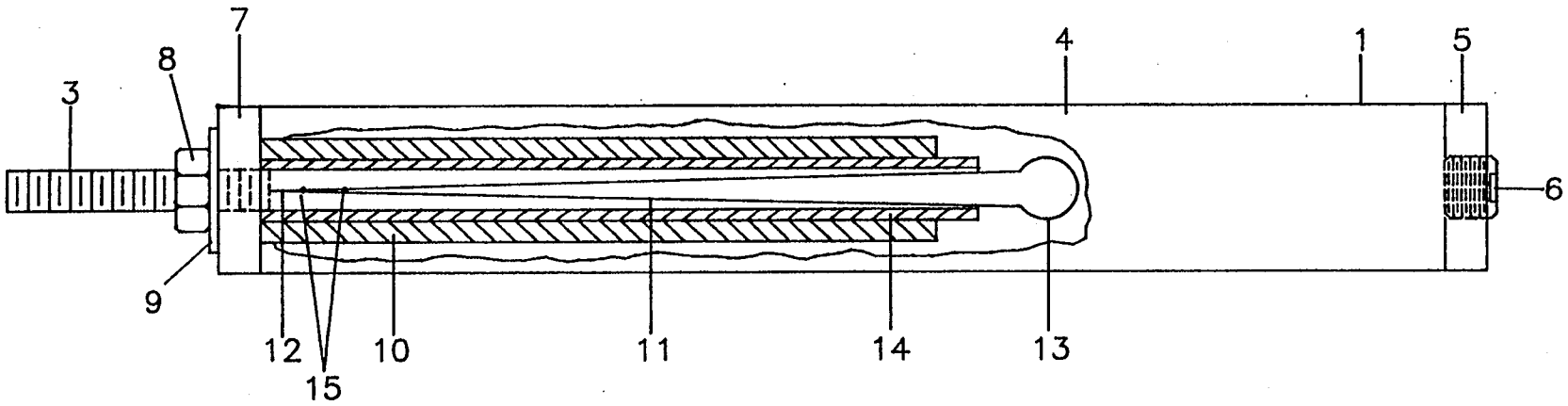

Referring to figure one it can be seen that the anti vibration device, or bow silencer 1, is mounted to the body of a bow 2 in a forward, horizontal position. The bow silencer 1 is mounted by way of the mounting stud 3.

Referring to figure two it can be seen that the bow silencer 1 comprises an outer barrel 4 which is plugged at its forward end by forward insert 5. Oil plug 6 is screwed into the center of forward insert 5. Oil, or some other suitable fluid, is introduced into the outer barrel 4 through oil plug 6. The rearward end of the outer barrel 4 is plugged by back insert 7. Mounting stud 3 is screwed through the center of back insert 7 and secured by mounting nut 8 and washer 9. Inner barrel 10 is centrally affixed, at one end, to back insert 7. Inner barrel 10 is in a position parallel to and inside of outer barrel 4 and extends forward from back insert 7 toward forward insert 5. An open ended loop of wire, or tuning wire 11, is affixed by the two terminals 12 at its open end to the forward end of mounting stud 3 at a point just inside the inner barrel 10. The closed loop, or forward end 13, of the tuning wire 11 extends just past the forward end of inner barrel 10. A tuning spacer 14, consisting of a tube of pliable rubber or other suitable material, is placed over the forward end 13 of the tuning wire 11, and into the forward end of inner barrel 10. The tuning spacer 14 keeps the tuning wire from coming into contact with the inner barrel 10. The two members of the open end of the tuning wire 11 are welded together to form tuning tacks 15 at two points just forward of the forward end of the mounting stud 3.

As the bow is drawn and released the vibration and noise created by the release of energy is transferred to the tuning wire 11 through the mounting stud 3. As the vibrations travel down the tuning wire 11, the vibration energy is absorbed by the fluid within the outer barrel 4. The tuning tacks 15 hold the tuning wire members the proper distance apart and therefore insure that vibrations are absorbed rather than traveling back down the tuning wire 11 into the bow 1. The tuning wire 11, inner barrel 10, outer barrel 4, and all other parts are sized and shaped properly so as to assure maximum vibration absorption, thus providing for an extremely effective sound and vibration control device.

I claim:

1. An apparatus to be mounted to a body of a compound bow for controlling noise and vibration comprising;

a. means for housing said apparatus, said means further comprising an outer barrel, said outer barrel comprising a cylinder having a forward end and a rearward end, said forward end having a forward insert, said forward end being plugged by said forward insert, said forward insert further comprising a threaded hole, said hole being traversed by a threaded oil plug, said oil plug screwed into said hole, said rearward end having a rearward insert, said rearward insert having a center, said rearward end being plugged by said rearward insert, said outer barrel being mounted to said body of said bow in a horizontal, forward extending position;

b. means for mounting said apparatus to said bow, said means further comprising a threaded mounting stud, said mounting stud having a forward end and rearward end, said stud being screwed into said body of said bow, said forward end traversing said center of said rearward insert; and c. means for transferring and absorbing said noise and vibration, said means further comprising an inner barrel, and a tuning wire, said inner barrel comprising a cylinder, said cylinder having a forward end and a rearward end, said rearward end of said cylinder being rigidly affixed to said rearward insert so as to horizontally position said inner barrel centrally within said outer barrel, said inner barrel extending from said rearward insert a portion of the distance toward said forward insert, said inner barrel being significantly shorter than said outer barrel, said outer barrel being filled with an energy absorbing fluid, said tuning wire comprising a "U" shaped loop of wire having a closed forward end and an open rearward end, said rearward end comprising two parallel legs, each of said legs having a terminal at its end, said terminals being rigidly affixed to said forward end of said mounting stud so as to be positioned within said inner barrel, said closed forward end extending just past said forward end of said inner barrel, said tuning wire and said inner barrel being immersed in said energy absorbing fluid so as to allow said energy absorbing fluid to absorb said vibrations as said vibrations travel from said bow down said tuning wire by way of said mounting stud and into said outer barrel.

2. An apparatus as recited in claim 1, wherein said means for transferring and absorbing said noise and vibration further comprise a tuning spacer, said tuning spacer further comprising a tube of pliable material, said tuning spacer being inserted into said forward end of said inner barrel and over said closed forward end of said tuning wire so as to prevent said tuning wire from coming into contact with said inner barrel, thus enhancing the performance of said tuning wire.

3. An apparatus as recited in claim 2, wherein said tuning wire further comprises a plurality of tuning tacks, said tuning tacks further comprising a weld or other connection between said parallel legs of said tuning wire at various points just forward of said mounting stud, thus stabilizing and enhancing the performance of said tuning wire.

* * * * *